US006997687B2

(12) United States Patent
Iritani

(10) Patent No.: US 6,997,687 B2
(45) Date of Patent: Feb. 14, 2006

(54) ELECTRIC COMPRESSOR

(75) Inventor: Kunio Iritani, Anjo (JP)

(73) Assignee: Denso Corporation, Kariya (JP)

( * ) Notice: Subject to any disclaimer, the term of this patent is extended or adjusted under 35 U.S.C. 154(b) by 257 days.

(21) Appl. No.: 10/423,930

(22) Filed: Apr. 28, 2003

(65) Prior Publication Data

US 2003/0206815 A1 Nov. 6, 2003

(30) Foreign Application Priority Data

May 1, 2002 (JP) ..... 2002-129960

(51) Int. Cl.
*F04B 35/04* (2006.01)
*H02K 9/16* (2006.01)

(52) U.S. Cl. ..... 417/371; 310/62

(58) Field of Classification Search ..... 310/52, 310/54, 62; 417/366, 371
See application file for complete search history.

(56) References Cited

U.S. PATENT DOCUMENTS

| | | | | |
|---|---|---|---|---|
| 5,908,286 | A * | 6/1999 | Clemmons | 417/366 |
| 6,198,183 | B1 * | 3/2001 | Baeumel et al. | 310/54 |
| 6,419,460 | B1 * | 7/2002 | Dantlgraber | 417/366 |
| 6,524,082 | B2 * | 2/2003 | Morita et al. | 310/52 |

FOREIGN PATENT DOCUMENTS

| | | |
|---|---|---|
| JP | A-7-288949 | 10/1995 |
| JP | A-2002-5024 | 1/2002 |

* cited by examiner

*Primary Examiner*—Michael Koczo, Jr.
(74) *Attorney, Agent, or Firm*—Posz Law Group, PLC

(57) ABSTRACT

In an electric compressor, in which an electric motor and a compressor driven thereby are integrated, in order to prevent a reduction in the durability of the electric motor and the like due to heat conducted from heat radiating bodies such as drive circuits, a fluid, prior to being taken into the compressor portion, is circulated through the electric motor portion as a medium for cooling. In this case, a plurality of cooling medium passages for example are provided parallel to the axis of rotation, and the endothermic capacity of passages formed in the vicinity of heat radiating bodies is made greater than the endothermic capacity of passages formed in other portions.

13 Claims, 9 Drawing Sheets

ELECTRIC COMPRESSOR

BACKGROUND OF THE INVENTION

1. Field of the Invention

The present invention relates to an electric compressor in which an electric motor portion and a compressor portion are integrated and, in particular, to an electric compressor in which a drive circuit portion for supplying electric power to the electric motor portion is integrated with the compressor portion.

2. Description of the Related Art

Attempts have been made to integrate a refrigerant compressor, for an air-conditioning system mounted in an automobiles, with an electric motor for rotatably driving the refrigerant compressor via a common rotating shaft, and to integrate a drive circuit portion, such as an inverter for supplying power to the electric motor, with the electric motor, in order to reduce the amount of wasted space and the size and weight of the overall structure, by using, in conjunction, as many components as possible, to facilitate installation of the compressor in a vehicle where there is not enough space, to simplify the arrangement of the transmission shaft, wiring, piping and the like linking the various components, and to reduce the cost.

When integrating a refrigerant compressor and electric motor in this way, as a means for cooling the electric motor, in which overheating is a problem due to the density of installation, a method of guiding a low temperature intake refrigerant, consisting mainly of gas returning to the refrigerant compressor from the evaporator during the refrigeration cycle, and cooling the inside of the electric motor by circulating this gas through the electric motor, can be performed. For this purpose, in the prior art, a passage for circulating the intake refrigerant, formed between the stator of the electric motor and the housing enclosing this, is normally provided uniformly surrounding the rotating shaft of the electric motor.

Consequently, where a heat radiating body such as a drive circuit portion including an inverter is integrated with part of the periphery of the housing of the electric motor and with other heat radiating bodies disposed in proximity thereto, due to heat emitted from the heat radiating bodies of the drive circuit portion and the like, part of the electric motor attached or in proximity thereto suffers from a localized rise in temperature because it cannot be sufficiently cooled, the temperature around the rotating shaft of the electric motor becomes non-uniform, and oscillation problems or the like occur due to differences in the minute space between the stator and armature as a result of localized heat expansion differences, resulting in a non-uniform magnetic field being generated by the stator and rotational imbalance, thus reducing efficiency. Also, because the drive circuit components such as the inverter and the like are not sufficiently cooled by indirect cooling alone from the inside of the electric motor by means of intake refrigerants returning to the compressor, there is a problem of a reduction in the durability of the drive circuit components.

SUMMARY OF THE INVENTION

The present invention, in light of the above problems of the prior art, has as its object, in the case of integrating an electric motor, a compressor driven thereby, and a drive circuit portion for supplying power to the electric motor, to guide a fluid that is introduced into the compressor to the electric motor, to uniformly cool the electric motor by circulating it therethrough, and to sufficiently cool the electric motor drive circuit portion integrally attached to a portion of the housing of the electric motor, thereby simultaneously solving the problems generated by non-uniform and insufficient cooling.

In the electric compressor of the present invention, in which an electric motor portion, a drive circuit portion including an inverter for operating the electric motor portion, and a compressor portion driven by the electric motor portion for compressing a fluid are integrated, in order to circulate the fluid taken in by the compressor portion prior to compression, as a cooling medium through the electric motor portion, a plurality of cooling medium passages are provided in the electric motor portion, among which those cooling medium passages provided in the vicinity of the drive circuit portion can have a greater endothermic capacity than that of the cooling medium passages provided in other portions. The drive circuit portion mentioned here includes a portion that is installed directly on to the electric motor housing, i.e. at least the electric motor housing side portion of the casing of the drive circuit portion is integrated with the electric motor housing.

In order to increase endothermic capacity, such methods as increasing the cross sectional area of the cooling medium passages or increasing the surface area of the cooling medium passages can be used. Other methods for increasing the endothermic capacity of the cooling medium passages include imparting different flow rates between the plurality of the cooling medium passages and imparting different temperatures to the circulating cooling medium; when imparting a difference in temperature, a method of the circulating a cooling medium, whose temperature has been increased by being circulated through the cooling medium passages in those portions where the endothermic capacity increases, through the cooling medium passages in those portions where the endothermic capacity is not required to be increased can, for example, be used.

In either case, as heat radiating bodies that increase the endothermic capacity of the cooling medium passages and which correspond to those portions of the cooling medium passages whose cross sectional area or surface area is to be increased, not only is there the drive circuit portion, but also heat radiating bodies such as an internal combustion engine mounted in the vehicle, for example.

In this way, the endothermic capacity of portions of the cooling medium passages corresponding to heat radiating bodies such as the drive circuit portion of the electric motor portion and the internal combustion engine disposed in proximity thereto can be increased, thereby avoiding the problem of a localized temperature rise in part of the electric motor portion, non-uniform temperature states around the rotating shaft of the electric motor portion, and partial heat expansion differences that result in vibrations and the like due to differences in the minute spaces between the stator and armature, as well as the problem of an irregular magnetic field generated by the stator resulting in rotational imbalance and a reduction in efficiency. Also, a reduction in the durability of the drive circuit portion itself due to insufficient cooling can be prevented.

A specific method for increasing the surface area of the cooling medium passages is to make a surface of the cooling medium passages an uneven surface. This uneven surface may be formed only on one surface of the cooling medium passages. The cooling medium passages may be disposed parallel to the rotating shaft of the electric motor portion, or may be imparted differences in endothermic capacity by disposing part of the plurality of cooling medium passages in a non-linear winding pattern.

When the electric compressor of the present invention is used as a refrigerant compressor for an automotive air-conditioning system, a refrigerant taken into the refrigerant compressor and returning from the evaporator during the refrigeration cycle can be used as the cooling medium to be circulated through the cooling medium passages. The effects of the present invention can thereby be maximized.

DESCRIPTION OF THE PREFERRED EMBODIMENTS

Figure 1:
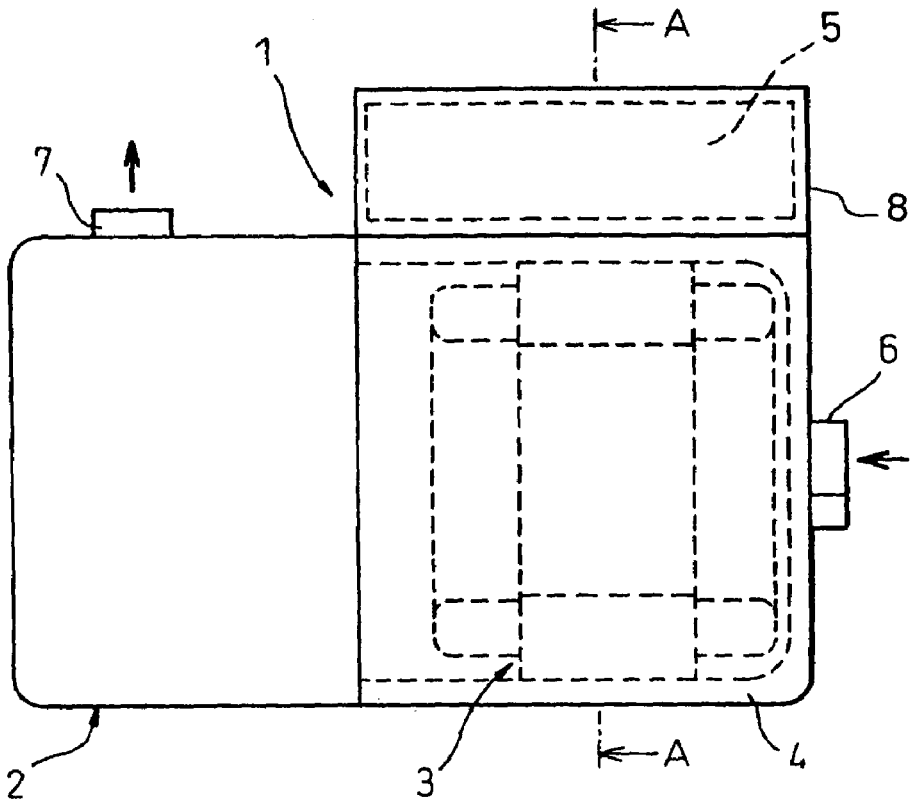
FIG. 1 is a sectional view illustrating the concept of the overall structure of the electric compressor common to all of the embodiments.

By reference to the attached drawings, the preferred embodiments of the present invention will be explained in detail. FIG. 1 illustrates the overall structure of the electric compressor common to eight specific embodiments of the present invention, relating to the main components of the electric compressor, shown in FIGS. 3 to 10, and FIG. 2 shows, in abbreviated form, the structure of a refrigeration cycle common to all of the embodiments, in a case where the electric compressor of the embodiments of the present invention is used as a refrigerant compressor in a refrigeration cycle of an air-conditioning system mounted in a vehicle such as an automobile.

In FIG. 1, the electric compressor 1 of the embodiments, for example, an air-conditioning system mounted in a vehicle, comprises a compressor portion 2 comprising a compressor such as a scroll type compressor or swash plate type compressor used as a refrigerant compressor, an electric motor portion 3, integrated with the compressor portion 2 on the axis of a common rotating shaft not shown in the drawing, for rotatably driving the compressor portion 2, and a drive circuit portion 5 integrally attached to part of the peripheral surface of the housing 4 of the electric motor portion 3 and containing an inverter or the like for supplying power to the electric motor portion 3. However, the present invention is not characterized by the specific structures of the compressor portion 2 and the drive circuit portion 5, nor by the form, structure and the like of the electric motor portion 3 itself, therefore most of the internal structures thereof have been omitted in the attached drawings.

In order to cool the electric motor portion 3 from the inside, an intake port 6 for receiving fluid (in this case a vaporized refrigerant) to be compressed in the compressor portion 2 is provided at the end portion of the electric motor portion 3 opposite the compressor portion 2. Meanwhile, an exhaust port 7 for discharging the fluid to be compressed in the compressor portion 2 is provided in part of the compressor portion 2 itself. Consequently, the refrigerant (intake refrigerant) to be compressed in the compressor portion 2 enters through the intake port 6 and flows into the housing 4 of the electric motor portion 3 in the direction of the arrow, is compressed in the compressor portion 2 after cooling the interior of the electric motor portion 3, and is discharged as a compressed refrigerant (discharge refrigerant) through the exhaust port 7 to the exterior of the electric compressor 1. The housing 4 of the electric motor portion 3, the casing 8 enclosing the drive circuit portion 5 for maintaining a waterproof quality, and the like, are produced from an aluminum alloy having suitable thermal conductivity.

Figure 2:
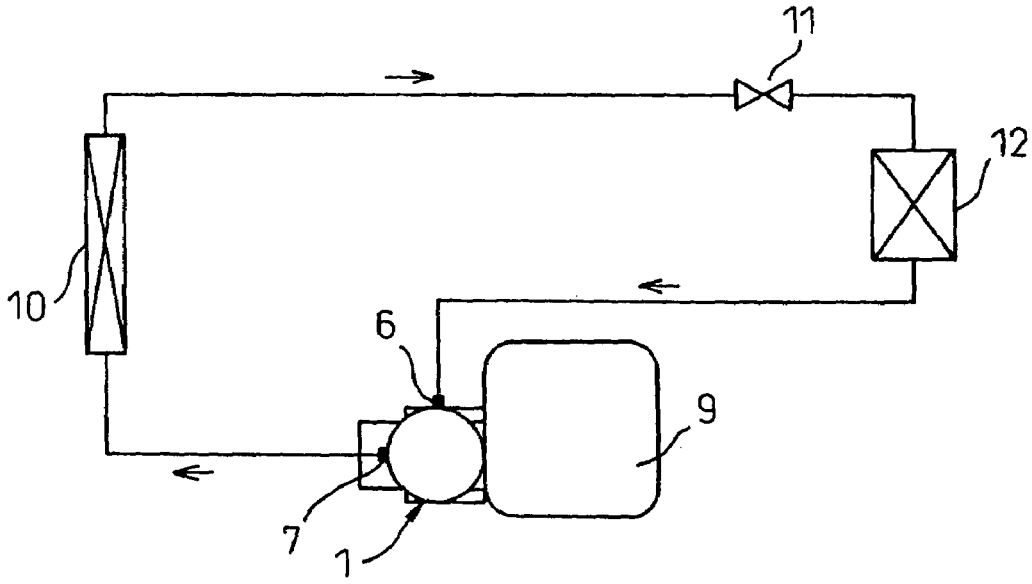
FIG. 2 is a block diagram of a refrigeration cycle illustrating a case where the electric compressor of the present invention is used.

In the case of the refrigeration cycle of the air-conditioning system shown in FIG. 2, although the electric compressor 1 is disposed in the vicinity of the engine 9 (internal combustion engine) to drive the vehicle, it is not directly driven by the crank shaft of the engine 9, but is driven by power supplied to the drive circuit portion 5 from a battery charged by a generator (not shown in the drawing) attached to the engine 9. The refrigerant compressed in the compressor portion 2 of the electric compressor 1 is discharged from the exhaust port 7 and flows into a condenser 10, which is a first heat exchanger, and radiates the heat produced during compression to the external atmosphere to liquefy the refrigerant. The liquid refrigerant is decompressed while passing through a throttle 11 such as an expansion valve, and flows in a gas/liquid mixture state into an evaporator 12, which is a second heat exchanger, to cool the air inside the vehicle when it is vaporized.

Stated briefly, the structural features of the electric compressor of the present invention can be said to reside in the form or structure, in cross section, of the electric motor portion 3 shown along the line A—A in FIG. 1. That is, the cross section A—A is the relevant part of the present invention, the form or structure thereof varying as explained below to distinguish the eight embodiments shown in FIGS. 3 to 10. Consequently, the structures of the embodiments are all the same except for these variations.

Figure 3:
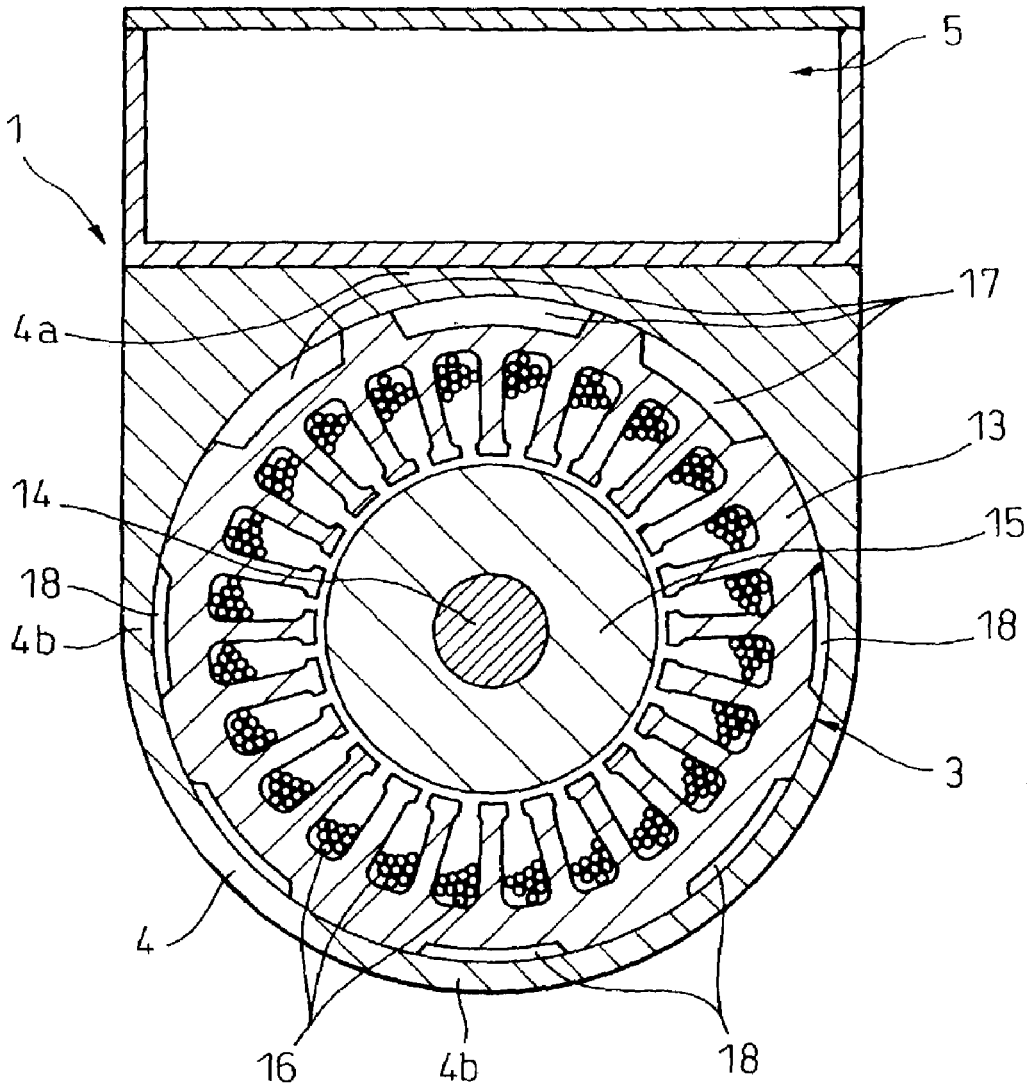
FIG. 3 is a cross sectional side view showing a first embodiment of the main portions of the electric compressor.

A first embodiment relating to the relevant part (cross section A—A) of the electric compressor of the present invention is shown in FIG. 3. Although this is a structure common to all of the embodiments, the electric motor portion 3 has a mainly ring-shaped stator portion 13 fixedly supported by a cylindrical surface formed inside the housing 4 of the electric motor portion 3, and a mainly cylindrical rotor portion 15 rotatably supported by a central rotating shaft 14 so that there is a slight gap between it and the inner peripheral surfaces of the stator portion 13, which has a comb-like shape. The rotating shaft 14 connects to a drive shaft, not shown in the drawing, of the compressor portion 2 on the same axis. Coils 16 are wound into slots (grooves) on the inner periphery of the stator portion 13. These coils 16 produce a rotating magnetic field moving in a predetermined direction on the fixed stator portion 13, by a three-phase alternating current (for example) supplied from the inverter housed in the drive circuit portion 5, and rotate the rotor portion 15 together with the magnetic field. The rotational speed of the rotating magnetic field can be freely controlled by changing the frequency of the three-phase alternating current applied to the coils 16 from the inverter.

As the electric motor portion 3 radiates heat from the coils 16 and the core that is the stator portion 13 and from the rotor portion 15, it is necessary to cool these parts to eliminate this heat. Therefore, a plurality of refrigerant passages are formed in groove shapes in the axial direction of the rotating shaft 14 around the peripheral surface of the stator portion 13, these refrigerant passages connecting at one end to the intake port 6 described above, and connecting at the other end to an inlet of the compressor portion 2, not shown in the drawing.

However, in the electric compressor 1 of the embodiment shown in the drawing, the drive circuit portion 5 including an inverter is attached to a portion 4*a* of the housing 4 of the electric motor portion 3, and because the inverter and the like also radiate heat, the temperature of the electric motor housing 4 in the vicinity of the portion 4*a* attached to the drive circuit portion 5 increases in comparison to a portion 4*b* in the electric motor housing 4 located opposite the portion 4*a* attached to the drive circuit portion 5. Consequently, unless the portion 4*a* attached to the drive circuit portion 5 is cooled more strongly than the opposite portion 4*b*, the overall temperature of the electric motor housing 4 cannot be equalized.

Thus, in the first embodiment of the present invention shown in FIG. 3, as well as increasing the cross sectional area of a plurality of first refrigerant passages 17 formed in the stator portion 13 in the vicinity of the portion 4*a* connected to the drive circuit portion 5 to increase the heat transfer surface area thereof, thus increasing the endothermic capacity and amount of refrigerant circulating through these portions, the cross sectional area and heat transfer surface area of a plurality of second refrigerant passages 18 formed in the stator portion 13 toward the portion 4*b* opposite the portion 4*a* are made relatively small, consequently decreasing the endothermic capacity thereof. Thus, among the low temperature refrigerant (mainly gas) returning to the compressor portion 2 of the electric compressor 1 from the evaporator 12, the amount circulating in the first refrigerant passages 17 is more than the amount circulating in the second refrigerant passages 18, therefore the amount of heat absorbed by the refrigerant circulating in the first refrigerant passages 17 is greater than the amount of heat absorbed by the refrigerant circulating in the second refrigerant passages 18, as a result of which the temperature of the stator portion 13 is substantially uniform across its entire periphery and is cooled to a balanced state. Not only can the previously described problems resulting from irregular cooling thereby be avoided, but the inverter of the drive circuit portion 5 can also be sufficiently cooled and operated without the possibility of deterioration.

Figure 4:
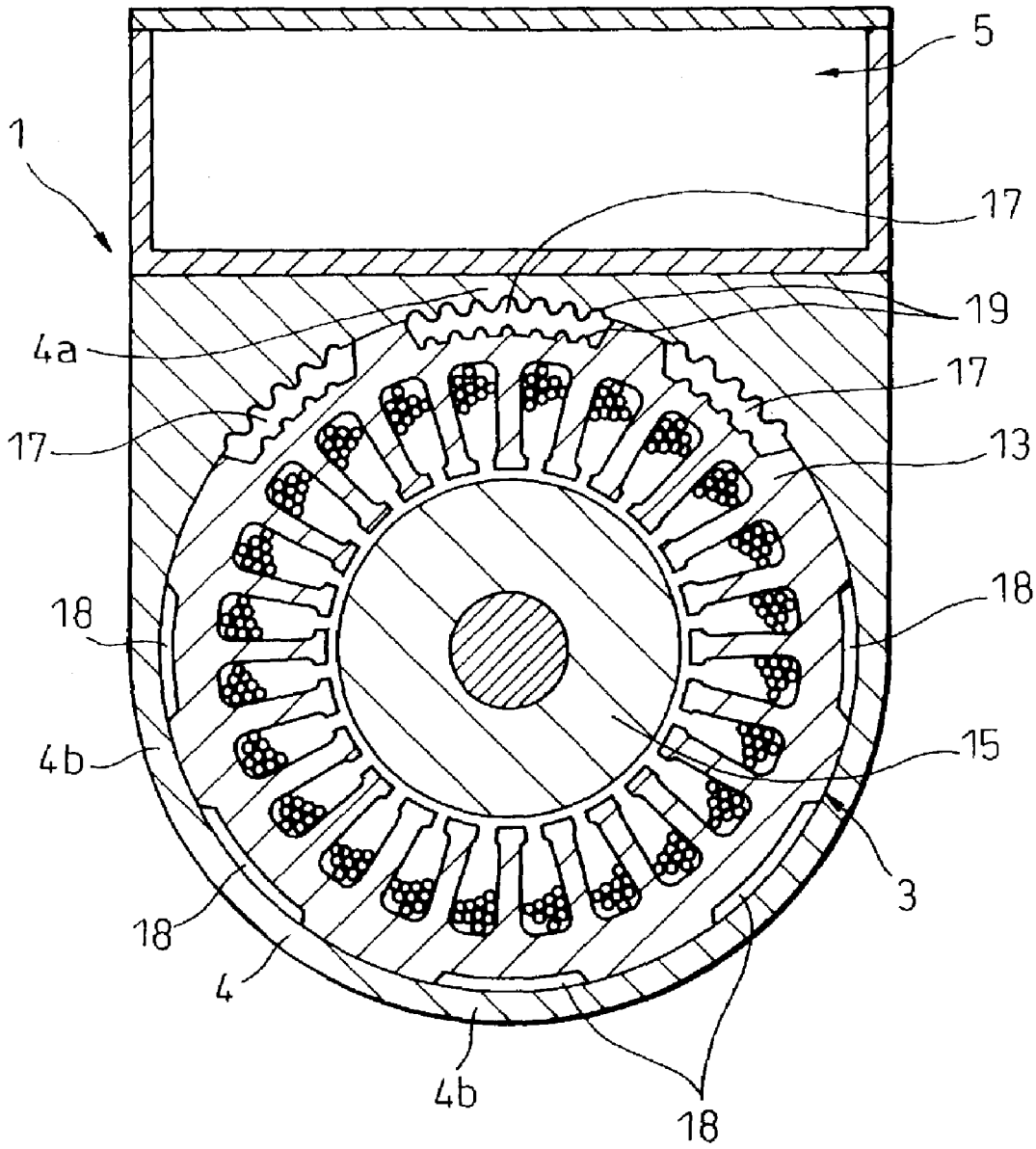
FIG. 4 is a cross sectional side view showing a second embodiment.

FIG. 4 shows a second embodiment of the present invention. The second embodiment is a further development of the first embodiment, and is characterized in that, as the first refrigerant passages 17 in the vicinity of the portion 4*a* attached to the heat radiating drive circuit portion 5 are formed from grooves on the cylindrical inner wall of the electric motor housing 4 and the cylindrical outer peripheral surface of the stator portion 13, by forming a plurality of protrusions (folds) on both surfaces of the first refrigerant passages 17 along the axial direction of the rotating shaft 14, or an uneven surface 19 comprising a plurality of protrusions or the like formed on both surfaces, the surface area of the portion 4*a* of the electric motor housing 4 close to the drive circuit portion 5 and portions where the stator portion 13 comes into contact with the refrigerant, i.e. the heat transfer surface area, is increased and the endothermic capacity of the first refrigerant passages 17 can be made higher than that of the second refrigerant passages 18. It is thereby possible to further increase the effects of the first embodiment.

Figure 5:
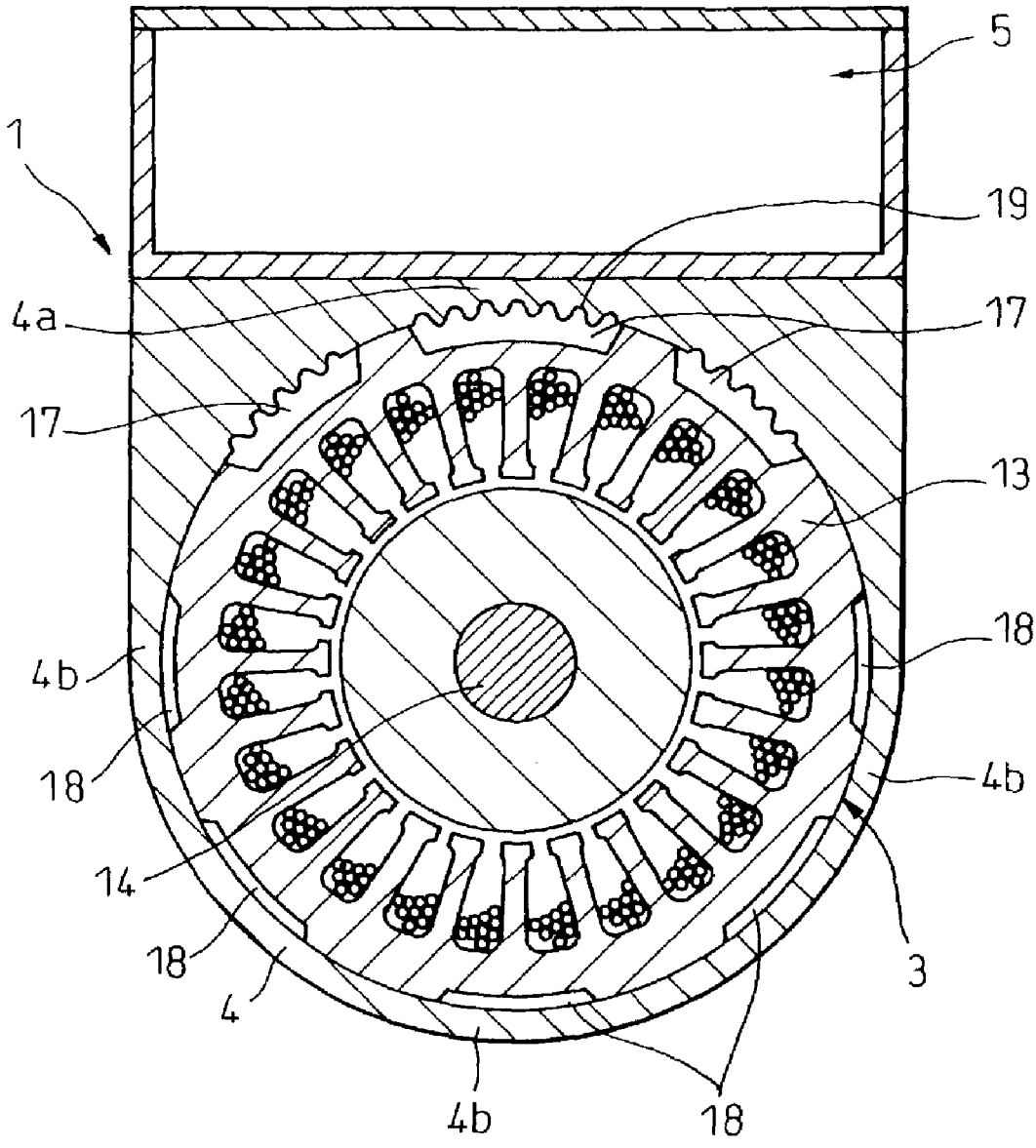
FIG. 5 is a cross sectional side view showing a third embodiment.
Figure 6:
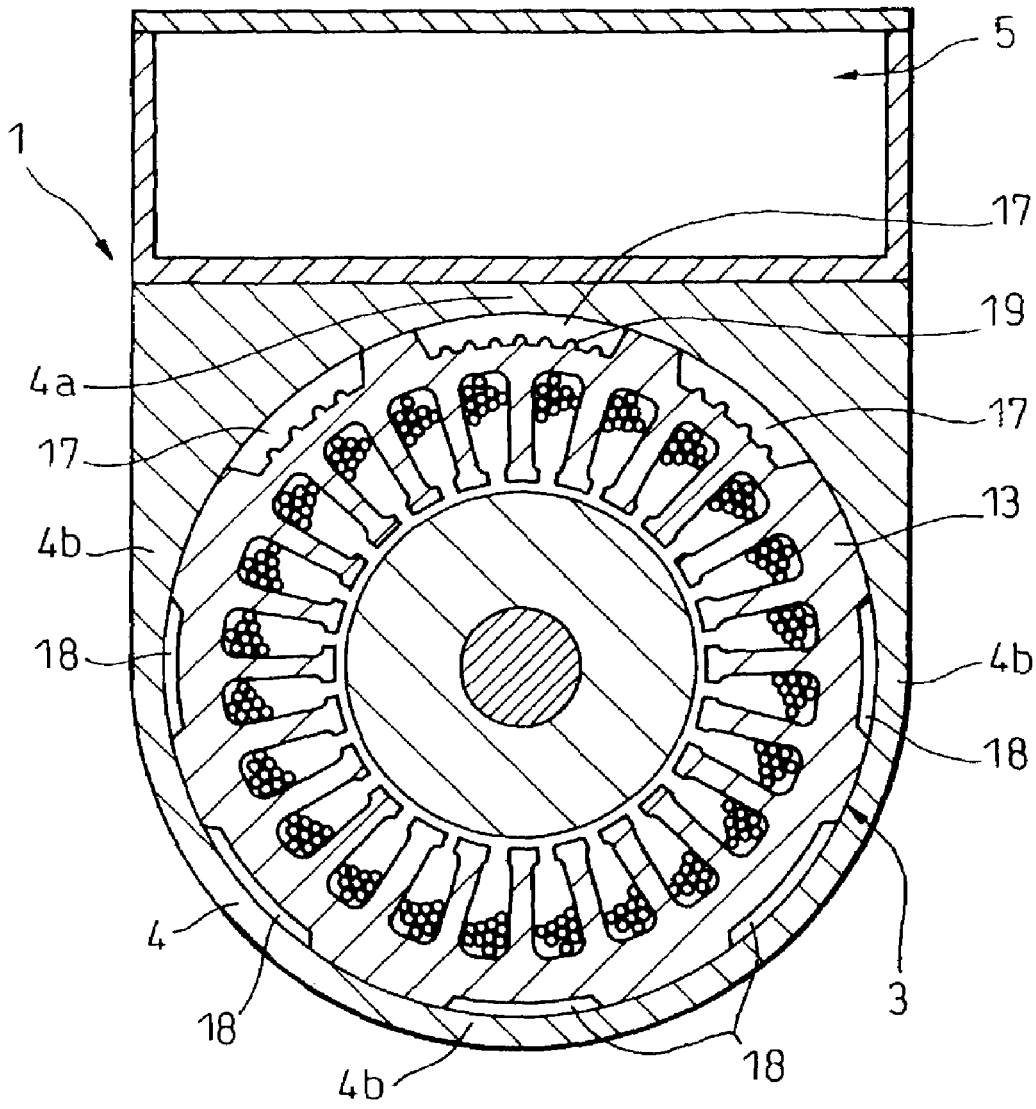
FIG. 6 is a cross sectional side view showing a fourth embodiment.

When it is not necessary to increase the endothermic capacity of the first refrigerant passages 17 to the extent of the second embodiment, an uneven surface 19 comprising protrusions or the like in portions corresponding to the first refrigerant passages 17 can be formed in the inner wall of the electric motor housing 4 as in the third embodiment shown in FIG. 5, or an uneven surface 19 can be formed in the bottom surface of the grooves forming the first refrigerant passages 17 on the stator portion 13 side as in the fourth embodiment shown in FIG. 6.

Also, when the electric compressor 1 is directly connected to a heat radiating body having a large shape and thermal capacity such as the engine 9, as in the refrigeration cycle example shown in FIG. 2, the electric compressor 1 receives not only heat radiated from the drive circuit portion 5 including the inverter, but it also receives heat conducted directly from the engine 9. Even if the electric compressor 1 is not directly connected to the engine 9 but is rather disposed in the vicinity of the engine 9, it still absorbs radiant heat emitted from the engine 9, resulting in non-uniform temperature distribution due to localized temperature increases in the electric compressor 1, and not only do the same problems as in the cases described above occur, but due to an overall temperature rise in the electric compressor 1 there is a possibility of heat damage occurring.

Figure 7:
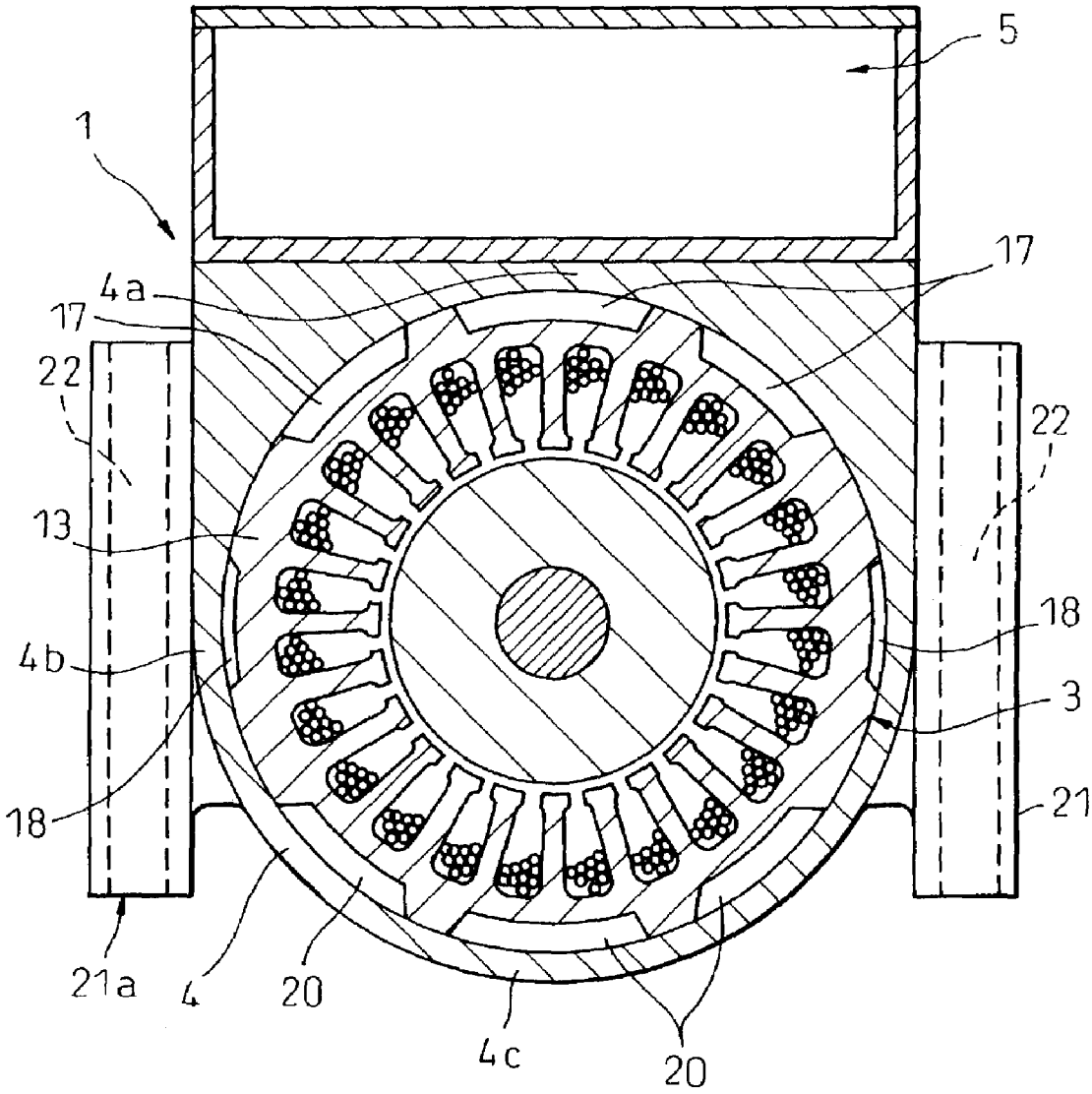
FIG. 7 is a cross sectional side view showing a fifth embodiment.

When there are these kinds of concerns, by increasing the cross sectional area and heat transferring area of not only the first refrigerant passages 17 which receive heat from the drive circuit portion 5, but also third refrigerant passages 20 formed in a portion 4*c* which receives radiant heat or heat conducted from the engine 9, and consequently increasing the flow rate of refrigerants in these portions and the endothermic capacity attained by this increase in flow rate over the amount in the second refrigerant passages 18, as in the fifth embodiment shown in FIG. 7, the endothermic capacity of these portions is increased. Specifically, 21 is a mount for attaching the electric compressor 1 to the engine 9 (the lower portion not shown in FIG. 7) and supporting it, and comprises through holes 22 for integrating the electric compressor 1 and for inserting bolts to attach the electric compressor 1 to the engine 9. The lower surface of the mount 21 is a contact surface 21*a* (attachment surface) and contacts the engine 9. In this case 4*b* indicates a portion distanced from both the previously described portions 4*a* and 4*c* in the electric motor housing 4.

Figure 8:
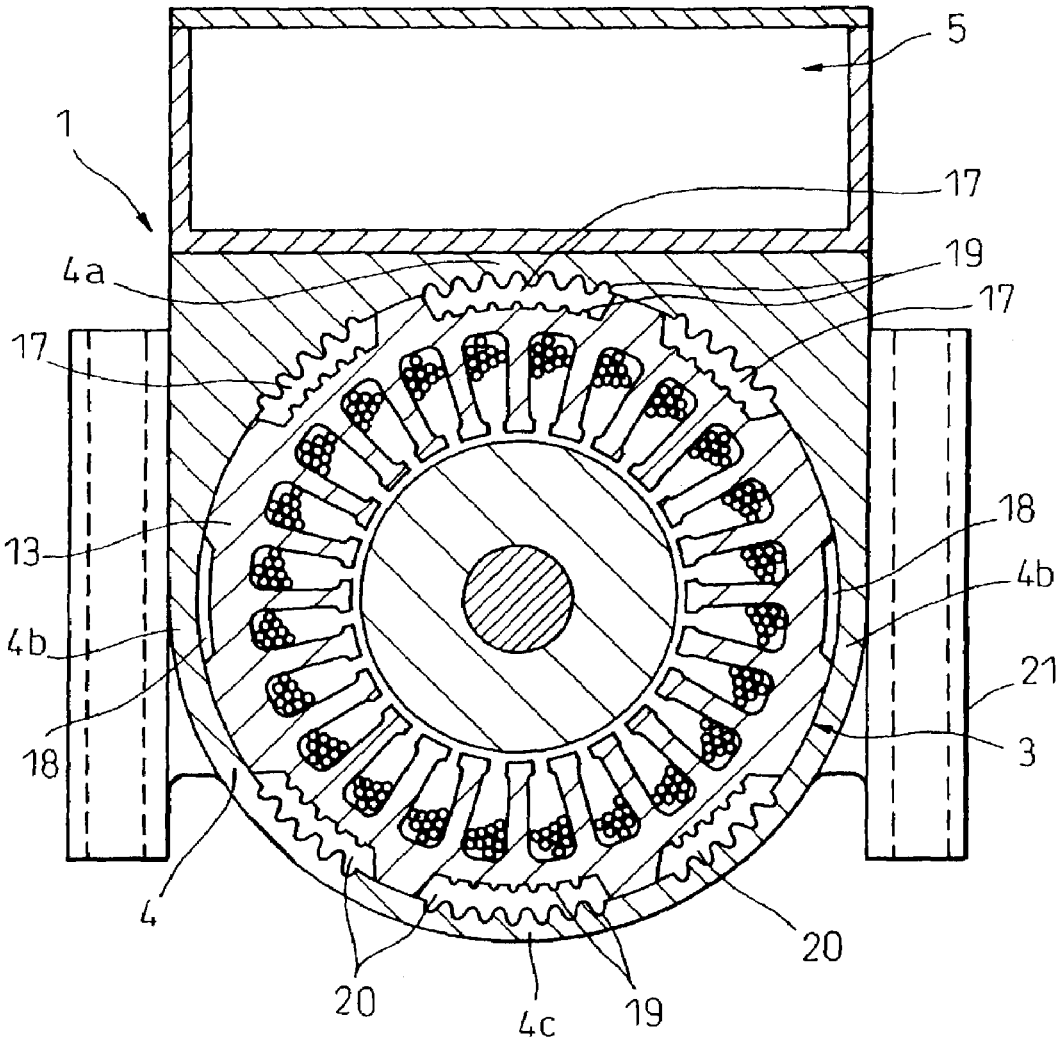
FIG. 8 is a cross sectional side view showing a sixth embodiment.

FIG. 8 is a sixth embodiment of the present invention. The sixth embodiment is a further development of the fifth embodiment and is characterized by providing uneven surfaces 19 on the cylindrical inner wall of the electric motor housing 4 and the bottom surfaces of the grooves of the cylindrical outer periphery of the stator portion 13 forming the first refrigerant passages 17 in the vicinity of the portion 4*a* to which the casing 8 of the drive circuit portion 5 that radiates heat is attached and the third refrigerant passages 20 formed in the vicinity of the portion 4*c* that receives heat from the engine 9. This increases the surface area of the portions 4*a* and 4*c* of the electric motor housing 4 close to the drive circuit portion 5 and engine 9, and the surface area of the stator portion 13 in contact with the refrigerant, i.e. the heat transfer surface area, and increases the endothermic capacity of the first refrigerant passages 17 and third refrigerant passages 20 over that of the second refrigerant passages 18. The effects of the fifth embodiment can thereby be increased even further.

Figure 9:
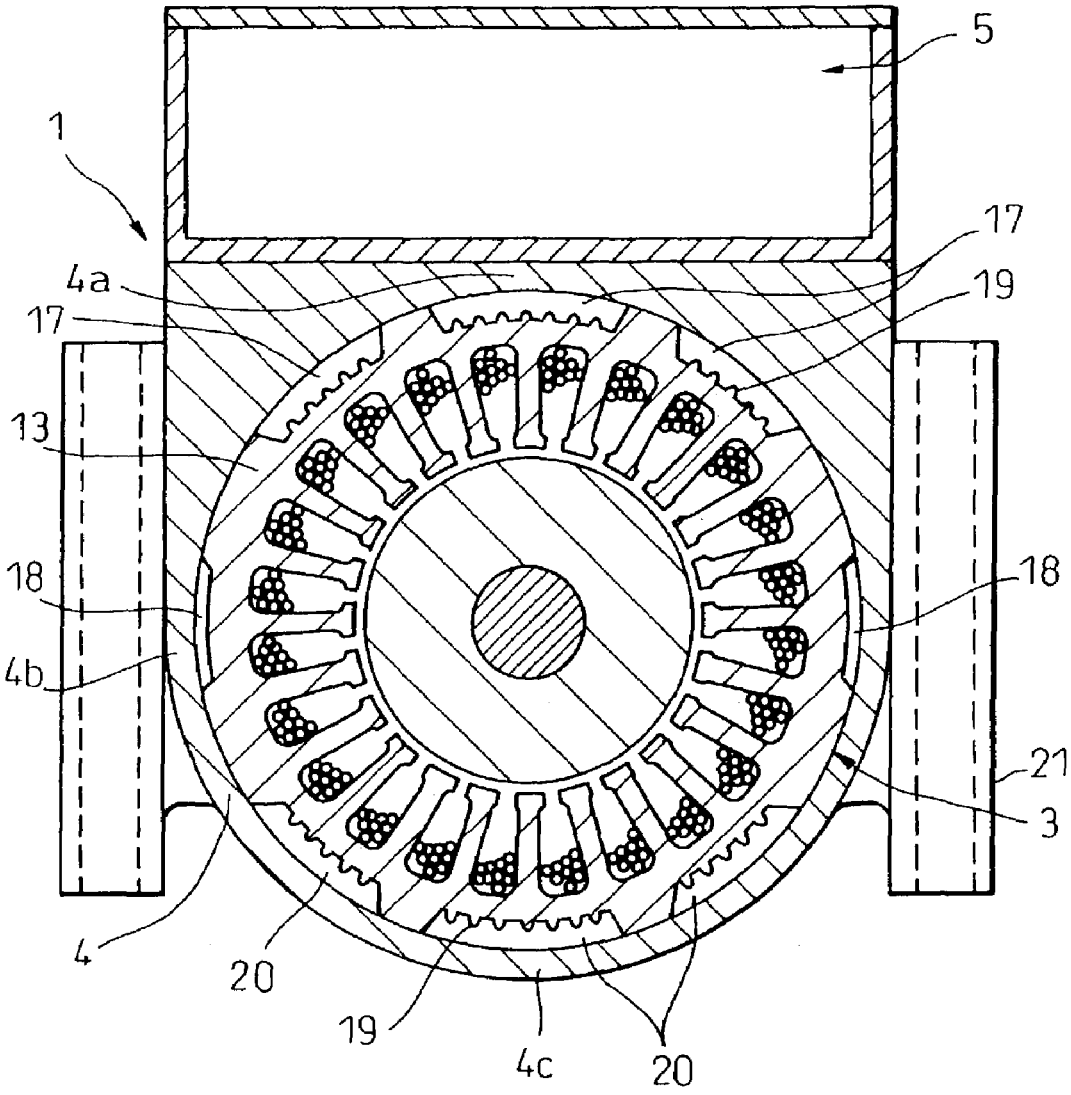
FIG. 9 is a cross sectional side view showing a seventh embodiment.
Figure 10:
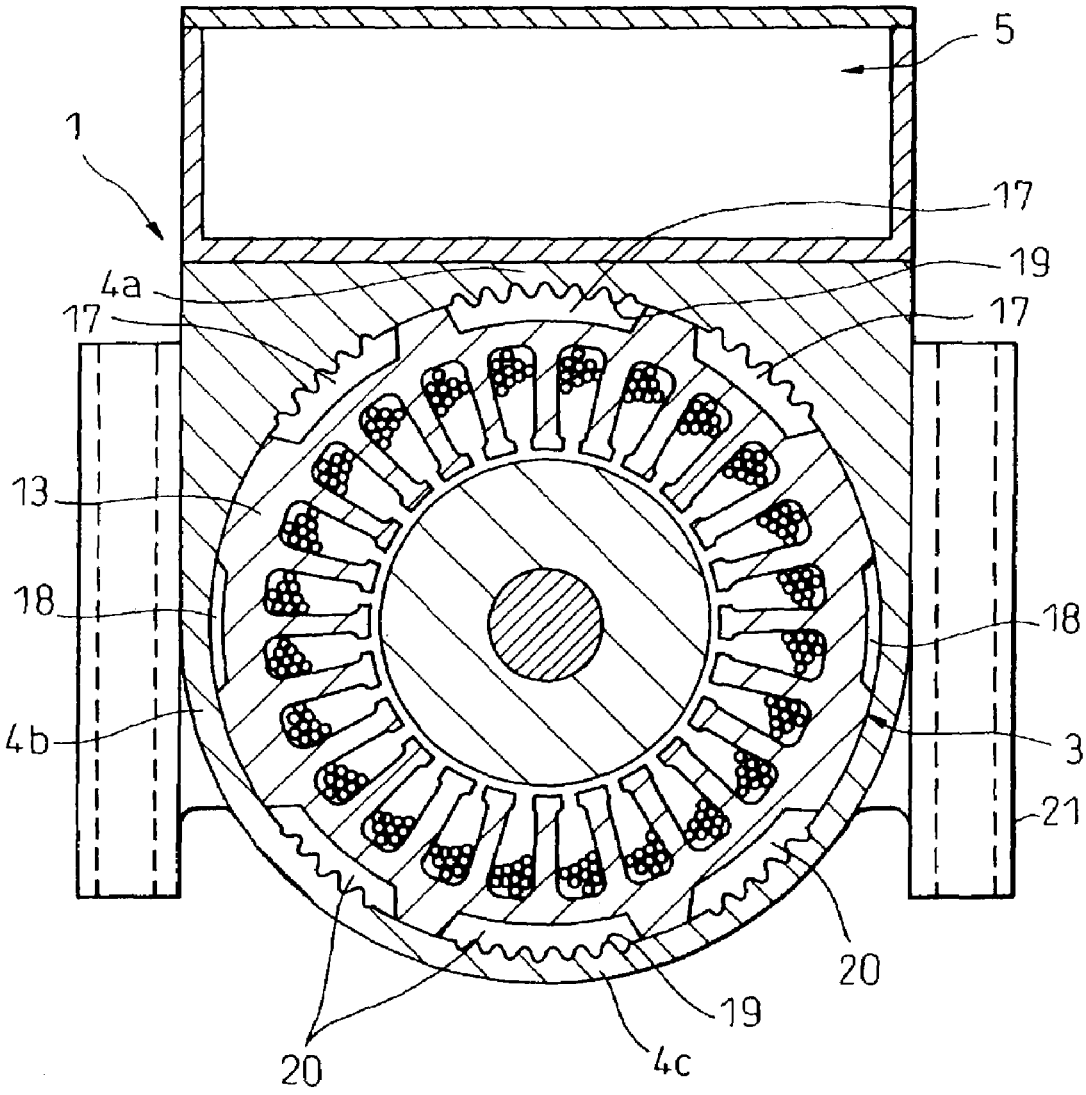
FIG. 10 is a cross sectional side view showing an eighth embodiment.

When it is not necessary to increase the endothermic capacity of the first refrigerant passages 17 and third refrigerant passages 20 to the extent of the sixth embodiment, an uneven surface 19 can be formed in the bottom surface of the grooves provided for forming the first refrigerant passages 17 and third refrigerant passages 20 on the stator portion 13 side as in the seventh embodiment shown in FIG. 9, or an uneven surface 19 can be formed in portions corresponding to the first refrigerant passages 17 and third refrigerant passages 20 in the inner wall of the electrical motor housing 4 as in the eighth embodiment shown in FIG. 10.

In the embodiments shown in the drawings, although the refrigerant passages 17, 18 and 20 are formed as grooves in the axial direction on the cylindrical outer surface of the stator portion 13, these are no more than simple examples and, where necessary, can be formed as narrow grooves in the axial direction in the cylindrical inner surface of the electric motor housing 4, for example. Needless to say, these refrigerant passages 17, 18 and 20 can also be formed in a shape other than a linear shape, for example as non-linear winding-shaped grooves.

What is claimed is:

1. An electric compressor comprising:

a housing;

an electric motor portion, wherein the electric motor portion is housed in the housing and includes a stator portion and a rotor portion;

a drive circuit portion for operating the electric motor portion, wherein the drive circuit portion is integrated with part of the periphery of the housing;

a compressor portion driven by the electric motor portion for compressing a fluid, wherein the compressor portion is housed in the housing; and a plurality of cooling medium passages provided between the inner surface of the housing and the outer surface of the stator portion to circulate fluid taken in by the compressor portion prior to compression as a cooling medium through the electric motor portion and, among the cooling medium passages, cooling medium passages that are located in proximity to the drive circuit portion have a greater endothermic capacity than others of the cooling medium passages that are not located in proximity to the drive circuit portion.

2. The electric compressor of claim 1, wherein a cross sectional area of the cooling medium passages that are located in proximity to the drive circuit portion is greater than a cross sectional area of the other cooling medium passages.

3. The electric compressor of claim 1, wherein a surface area of the cooling medium passages that are located in proximity to the drive circuit portion is greater than a surface area of the other cooling medium passages.

4. The electric compressor of claim 3, wherein, in order to increase the surface area of the cooling medium passages, the cooling medium passages include an uneven surface.

5. The electric compressor of claim 4, wherein the uneven surface is formed on only one surface of the cooling medium passages.

6. The electric compressor of claim 1, wherein the electric compressor is located in proximity to a relatively hot body other than the drive circuit portion, and cooling medium passages that are located in proximity to the drive circuit portion are first passages, and the other cooling medium passages, which are not located in Proximity to the drive circuit portion are second passages, and the electric compressor includes additional cooling medium passages, which are third passages, and the third passages are located in proximity to the relatively hot body, and the endothermic capacity of the third passages, is greater than the endothermic capacity of the second passages.

7. The electric compressor of claim 6, wherein the cross sectional area of the first passages is greater than the cross sectional area of the second passages, and the cross sectional area of the third passages is greater than the cross sectional area of the second passages.

8. The electric compressor of claim 6, wherein the surface area of the first passages is greater than the surface area of the second passages, and the surface area of the third passages is greater than the surface area of the second passages.

9. The electric compressor of claim 6, wherein, in order to increase the surface area of the cooling medium passages, the cooling medium passages include an uneven surface.

10. The electric compressor of claim 1, wherein the cooling medium passages are disposed parallel to a rotating shaft of the electric motor portion.

11. The electric compressor of claim 1, wherein the electric compressor is used as a refrigerant compressor for an automotive air-conditioning system, and the cooling medium is refrigerant returning from an evaporator.

12. The electric compressor of claim 6, wherein the relatively hot body other than the drive circuit portion is an internal combustion engine.

13. An electric compressor comprising:

a housing;

an electric motor, wherein the electric motor is housed in the housing and includes a stator and a rotor;

a drive circuit for operating the electric motor, wherein the drive circuit is integrated with an outer surface of the housing and produces heat;

a compressor driven by the electric motor for compressing a fluid, wherein the compressor is housed in the housing;

a plurality of cooling passages provided between the inner surface of the housing and the outer surface of the stator to conduct a coolant fluid, which is to enter the compressor and be compressed, through the electric motor to cool the motor, and wherein the plurality of cooling passages include first cooling passages, which are located generally between the drive circuit and the stator in a relatively more heated portion of the housing, and second passages, which are not located in proximity to the drive circuit and are located in a relatively less heated portion of the housing, and wherein the first cooling passages have a greater endothermic capacity than the second cooling passages.

* * * * *